US005165474A

United States Patent [19]

Buisine et al.

[11] Patent Number: 5,165,474

[45] Date of Patent: Nov. 24, 1992

[54] ANTI-ROTATION DEVICE FOR CEMENTING PLUGS WITH DEFORMABLE PERIPHERAL "FINS" OR "LIPS"

[75] Inventors: Paul Buisine, La Fouillouse; Gilbert Lavaure, Saint Etienne, both of France

[73] Assignee: Dowell Schlumberger Incorporated, Tulsa, Okla.

[21] Appl. No.: 718,068

[22] Filed: Jun. 21, 1991

[30] Foreign Application Priority Data

Jun. 26, 1990 [FR] France ..... 90 08305

[51] Int. Cl.[5] ..... E21B 33/16; E21B 41/00

[52] U.S. Cl. ..... 166/242; 166/156; 166/291; 166/327

[58] Field of Search ..... 166/291, 153-156, 166/202, 192, 242, 327

[56] References Cited

U.S. PATENT DOCUMENTS

| | | | |
|---|---|---|---|
| 1,912,578 | 6/1933 | Halliburton | 166/291 |
| 2,560,692 | 7/1951 | Hall | 166/156 |
| 2,717,645 | 9/1955 | Schnitter | 166/156 |
| 4,190,112 | 2/1980 | Davis | 166/291 |
| 4,836,279 | 6/1989 | Freeman | 166/291 X |
| 5,025,858 | 6/1991 | Glaser | 166/156 |

*Primary Examiner*—Stephen J. Novosad
*Attorney, Agent, or Firm*—Stephen A. Littlefield

[57] ABSTRACT

Cement plugs used in the cementing of casing in a borehole drilled into a subterranean formation are restrained from rotation by being forced into a portion of the casing and check valve apparatus which includes a reduced diameter section formed as a continuous annular liner of material having a coefficient of friction. Compression of the plug against the high-friction liner avoids rotation of the plugs when they are drilled subsequent to the cementing operation.

5 Claims, 3 Drawing Sheets

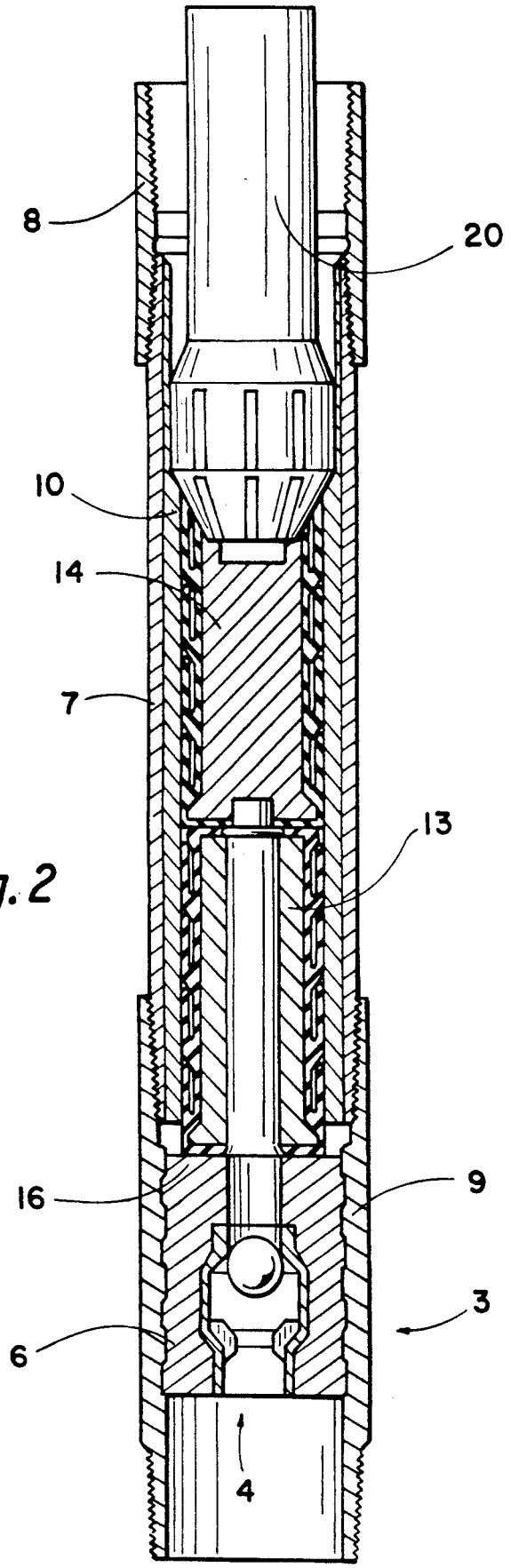
Fig. 2
Fig. 3
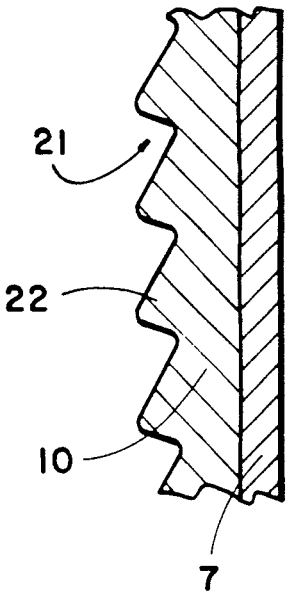

ANTI-ROTATION DEVICE FOR CEMENTING PLUGS WITH DEFORMABLE PERIPHERAL "FINS" OR "LIPS"

The present invention relates to drilling and exploitation techniques for oil or gas or similar wells, and within these techniques, it mainly relates to the phase consisting of performing the so-called cementing operation.

The drilling and exploitation operation of the well is performed in successive steps and consists in internally coating the drilled well with a casing. For each drilling step, the casing is equipped, at its lowermost portion, with a holding sleeve generally provided with an internal check valve.

Originally, the casing with its check valve is lowered inside the well filled with a drilling mud. The casing at this time also is filled with drilling mud.

The first cementing operation consists in circulating for a certain time the drilling mud so as to properly clean the annulus of all the drilling fragments which it can contain.

Then, one or several bottom plugs are launched from the surface and are pushed downwards by a cement slurry or by a chemical wash or by fluid spacers provided under pressure.

Such plugs were described in patent application EP-89 203 297.0 and patent application FR-90 08 139 entitled "Bouchons de cimentation de puits notamment petroliers et analogues, ensemble de bouchons pour l'exécution d'une operation de cimentation et equipement en faisant application".

When the amount of cement slurry, calculated to coat a certain height of the annulus between the casing and the rock, has been injected, a top plug is launched and pushed by a displacement fluid (generally mud).

The cement slurry is imprisonned between the bottom plug or plugs and the top plug, the role of which is to prevent a mixture of the cement slurry with the upstream and downstream fluids, and also to scrape the inside of the casing so as to avoid leaving any deposit on the internal wall.

When the bottom plug(s) come into contact with the check valve, an over-pressure, generated from the surface, tears up the bottom plug or plugs membrane, which allows the cement slurry to pass into the annulus between the casing and the drilled rock formation.

The top plug continues downwards and finally contacts the bottom plugs, which rest on the top face of the holding sleeve.

Generally, at this time, a pressure test of the casing is performed. The plug pile has to support this pressure.

Then, the pressure is released, and the check valve prevents the slurry from returning into the casing.

If the check valve doesn't operate in a normal way, a sufficient pressure is maintained, from the surface, inside the casing to apply the plugs against the holding sleeve shoulder.

This pressure is maintained for the duration necessary for the cement slurry setting.

After the cement setting, it is necessary to perform the plug drilling by means of a drilling tool, so as to continue with the drilling operation for a further depth step.

The performance of the plug drilling operation raises a certain number of problems, which it would be appropriate to eliminate in order to insure an appropriate evolution of the drilling operation itself, in particular to reduce the plug drilling time.

The use of plugs with deformable peripheral lips or "fins" implies manufacturing them, starting from an internal body or core with an elastomeric material coating adhering strongly with this core and forming the deformable peripheral lips.

When such plugs have to be drilled, the drilling tool to be used necessarily has, at the level of its operating head, a diameter slightly smaller than the inside diameter of the casing.

As the drill passes through the plugs, a ring of elastomeric material remains around the smaller outer surface of the drilling tool. This residual elastomeric ring may elastically contract around the drilling tool or the attached drill string as it progresses downwardly in the drilling operation.

Such an elastomeric material ring establishes a kind of relative sealing behind the drilling tool, which causes a sensible warming up of the unit and, mostly, opposes a proper circulation and return movement of the fluid used to assist in the drilling operation.

In an attempt to eliminate the general problems thus raised, it is necessary to submit the drilling tool to a reciprocating vertical movement, simultaneously with the rotation drive, and to exert very high drilling pressures.

In addition to the difficulty of performing a proper plug drilling in the above conditions, it should be noted that a second problem stems from the tendency of the plug to rotate as it is hit by the tool. This rotation opposes an efficient drilling and further complicates the operation, which already tends to represent a difficult and delicate performance due to the existence of the elastomeric material ring.

In addition, the above problem increases the plug drilling duration, which is an extremely important economic parameter.

In order to bring a solution to the above problem, the previous techniques, as described in the U.S. Pat. No. 4,858,687, have proposed providing the bottom and top plugs with radially directed notches formed on the transversal faces. This arrangement, which also has to be performed on the holding sleeve shoulder, implies the need for a special manufacturing, which sensibly burdens the cost of both the plugs and the holding sleeve without bringing a sure efficiency in all cases.

The present invention aims at overcoming the above problem by proposing a new anti-rotation device designed to facilitate the drilling of cement plugs used in well drilling, and in particular but not exclusively in oil or similar wells.

In order to reach the above aim, the anti-rotation device designed for cementing plugs with deformable peripheral "fins" or "lips", used for exploitation of oil or similar wells, is characterized in that it includes a tubular portion:

- designed to be interposed between the lowermost element of a casing and the bottom holding sleeve,
- made of a material with a strong friction coefficient, and easily drillable by a drilling tool,
- delimiting, from its bottom opening on, an internal convergent opening into a straight section with a diameter substantially equal to or lower than that of the plugs in the prestressed state of the lips,
- and having, from said section on, a bore with the same diameter as the latter, extending over an axial length at least equal to that occupied by at least two plugs in abutting contact.

Various other features will appear from the following description taken in reference with the appended drawings which represent, as non limiting examples, embodiments of the invention object.

FIG. 2 is an elevation section illustrating the plugs drilling operation by means of an anti-rotation device.

FIG. 3 is a fragmentary elevation section of an embodiment detail.

Figure 1:
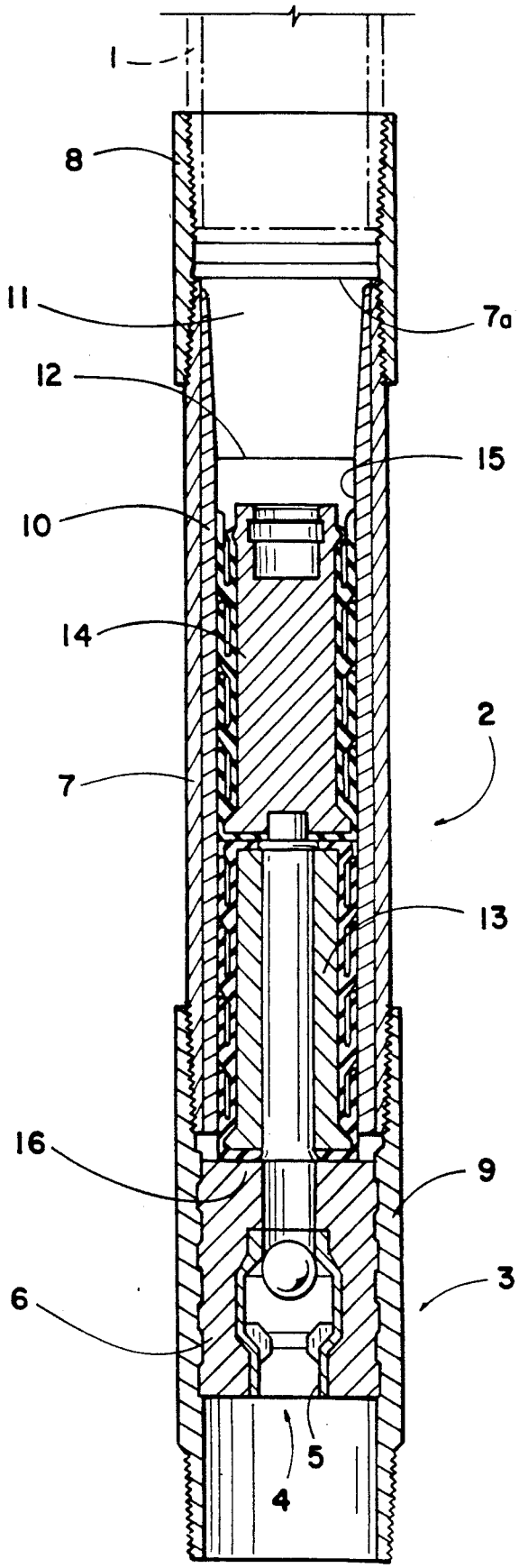
FIG. 1 is an elevation section of the device according to the invention.

FIG. 1 shows a first example of an embodiment of the anti-rotation device according to the invention, designed to be adapted at the bottom of a casing 1 and more particularly at the lower end of the bottom tubular element. The device according to the invention, designated as a whole by the reference numeral 2, is designed to be interposed between the tubular element 1 and a holding sleeve 3 which, according to be conventional techniques, generally includes, inside thereof, a check valve 4, the body 5 of which is wrapped in an easily drillable filling material 6.

In the illustrated example, the device 2 is made of a casing segment 7 designed to be joined by conventional means on a coupling sleeve 8 for the tubular element 1 on one hand, and on or in the collar 9 of the holding sleeve 3 on the other hand. In this example, the segment 7 preferably is made of a tubular element 1, used to constitute the casing.

Segment 7 is internally coated with a liner 10 made of a material with a high friction coefficient and easily drillable by a conventional drilling tool. As a preferred example, such a material is, for instance, made of cement.

The liner 10 is realized in such a way as to delimit, from the opening *7a* of segment 7 on, a convergent 11 opening into a transversal section 12 with a diameter sensibly equal to or even smaller than that of the bottom 13 and top 14 plugs, the reference diameter being the diameter corresponding to the prestressed state of the deformable peripheral lips. From the section 12 on, the liner 10 then presents a constant bore 15, with a regular diameter equal to that of the section 12. The bore 15 extends over an axial length which is at least equal to that occupied by at least two plugs, such as 13 and 14 disposed in abutting contact.

During this cementing operation, such as set forth above, the bottom plug 13 initially is launched into the tube 1 and is forced by the pressurized upstream fluid to penetrate into the convergent 11 which it is guided accordingly to an axial path which introduces it into the bore 15 where it is submitted to a deformation stress of the peripheral lips which it bears. Plug 13 consequently has to move inside the bore 15 until it is in abutting position resting on a shoulder 16 which forms the check valve 4. After the cementing operation, top plug 14 is launched in a similar manner to be guided in an axial penetration into the bore 15 by the convergent 11. Plug 14 is submitted to the same deformation stress of the peripheral lips and is led inside the bore 15 until it abuts against bottom plug 13.

In this situation, as represented in FIG. 2, both plugs 13 and 14 are axially and angularly fixed by the clamping stress peripherally applied to them as a result of their forced penetration into bore 15.

A drilling operation by means of a drilling tool 20 can then intervene, as illustrated in FIG. 2, which shows that the penetration of this tool results in an attack of the liner 10 over a diameter larger than that of plugs 14 and 13 successively.

In this manner, drilling is performed on the diameter total of the prestressed plugs, which eliminates the presence of an elastomeric material ring which remains in the conventional drilling operation. In this manner, the drilling tool is not limited to its free rotation, and the muds or other drilling fluids which can circulate and return upward to gradually free the drill fragments as the drilling tool advances.

An unchecked rotation of plugs 14 and 13 is absolutely excluded due to the radial prestress which is initially applied to them when they are forcedly introduced into bore 15.

To facilitate anchoring of plugs 14 and 13, it can advantageously be forecast to design the liner 10 so that it includes at least, on a part of the internal periphery of bore 15, successively negative and positive profiles 21, such as saw teeth, constituting buttress toothings 22, and opposing the rotation of plugs 14 and 13 on the one hand, and their axial displacement on the other hand, as soon as they have forcedly been introduced into the bore 15 in abutment against shoulder 16 (FIG. 3).

It should be noted that the maximum radial stress imposed onto plugs 14 and 13 results in a perfect bottom sealing with the holding sleeve 3.

Another advantage of the invention device consists in the presence of the convergent 11 which guarantees a guiding of plugs 13 and 14 to give at them an axial orientation which facilitates their introduction into bore 15. Any plug jamming risk is thus eliminated.

Such a sure axial guiding allows insuring that a proper transversal butt contact is established between plugs 13 and 14, which further improves the bottom sealing which they insure before the drilling operation.

Figure 4:
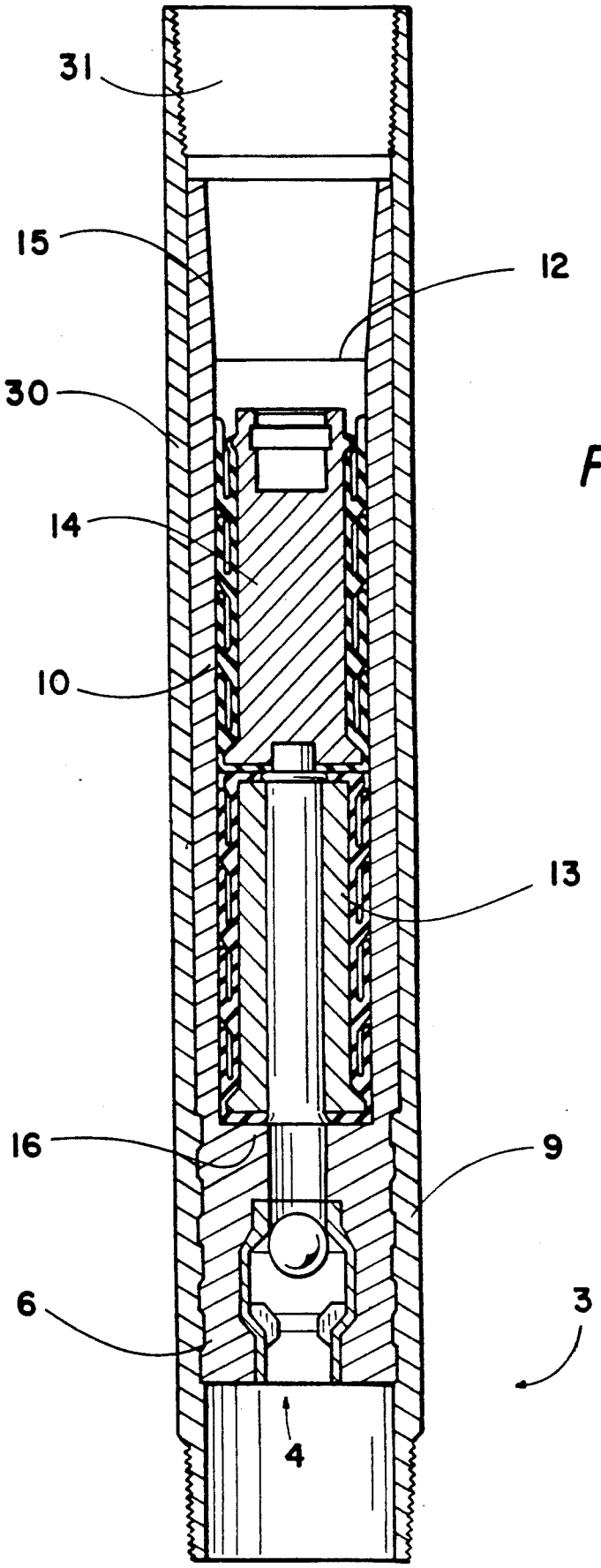
FIG. 4 is an elevation section similar to FIG. 1, illustrating another embodiment of the invention device.

FIG. 4 shows an alternate embodiment according to which the tubular portion forming the liner 10 is an integral part of the holding sleeve 3 which, for this purpose, includes a tubular upward extension 30 having, at its upper end, a means 31 for direct connection with the tubular element 1. In such an embodiment, the liner 10 is formed inside the upward tubular extension 30 and can be an integral part of the coating 6 of check valve 4, rising, in particular, from the shoulder 16 on.

The invention is not limited to the described and representated examples, since various modifications can be brought while staying inside the scope of the invention.

We claim:

1. In an apparatus for cementing tubular well casing in a well bore including a check valve disposed in a bottom holding sleeve, the improvement which comprises a tubular element disposed between an end of said casing and said holding sleeve adapted to receive at least two cementing plugs each having a plug length, said tubular element having a first internal diameter substantially equal to an internal diameter of said casing, a portion of said tubular element having a continuous annular liner having a high coefficient of friction, a second internal diameter smaller than said first diameter, a length at least equal to the combined lengths of said cement plugs and a portion of said liner comprising a tapered diameter section convergent from said first diameter to said internal diameter of said liner.

2. The improvement as set forth in claim 1 wherein the liner comprises an extended portion of said holding sleeve which includes said check valve.

3. The improvement as set forth in claim 1 wherein said liner is formed of cement.

4. The improvement as set forth in claim 1 wherein the liner includes negative and positive profiles along its internal diameter.

5. The improvement as set forth in claim 4 wherein said profiles comprise annular buttress toothings toward a cup opening.

* * * * *